US010918197B2

(12) United States Patent
Wang et al.

(10) Patent No.: US 10,918,197 B2
(45) Date of Patent: Feb. 16, 2021

(54) CLEANING DEVICE

(71) Applicant: BEIJING XIAOMI MOBILE SOFTWARE CO., LTD., Beijing (CN)

(72) Inventors: Tao Wang, Beijing (CN); Ziran Zhao, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 46 days.

(21) Appl. No.: 16/362,518

(22) Filed: Mar. 22, 2019

(65) Prior Publication Data

US 2019/0298053 A1 Oct. 3, 2019

(30) Foreign Application Priority Data

Apr. 3, 2018 (CN) ..... 2018 1 0293052

(51) Int. Cl.

| | |
|---|---|
| ***A46B 9/10*** | (2006.01) |
| ***A46B 15/00*** | (2006.01) |
| ***A46B 3/00*** | (2006.01) |
| ***A46B 11/00*** | (2006.01) |
| ***A46B 7/00*** | (2006.01) |
| ***A46B 9/12*** | (2006.01) |
| ***A46B 9/08*** | (2006.01) |

(52) U.S. Cl.

CPC ..... *A46B 9/10* (2013.01); *A46B 3/00* (2013.01); *A46B 7/00* (2013.01); *A46B 9/08* (2013.01); *A46B 9/12* (2013.01); *A46B 11/0003* (2013.01); *A46B 15/00* (2013.01); *A46B 15/0093* (2013.01)

(58) Field of Classification Search

CPC .... A46B 3/00; A46B 7/00; A46B 7/02; A46B 7/023; A46B 9/08; A46B 9/10; A46B 9/12; A46B 15/00; A46B 15/0093; A46B 11/00; A46B 11/0003; A46B 11/001; A46B 11/0068; A46B 11/0006

USPC ..... 15/104.94, 168, 169, 184, 194, 202

See application file for complete search history.

(56) References Cited

U.S. PATENT DOCUMENTS

| | | | | | |
|---|---|---|---|---|---|
| 1,080,633 | A * | 12/1913 | Husch | A46B 15/00 | 15/194 |
| 1,080,634 | A * | 12/1913 | Husch | A46B 15/00 | 15/194 |
| 1,103,515 | A * | 7/1914 | Husch | A46B 3/12 | 15/191.1 |
| 1,451,775 | A * | 4/1923 | Husch | A46B 5/00 | 15/194 |
| 5,913,348 | A * | 6/1999 | Horton | A46B 17/04 | 15/169 |
| 7,730,572 | B2 * | 6/2010 | Weiss | A46B 7/04 | 132/321 |

FOREIGN PATENT DOCUMENTS

| | | |
|---|---|---|
| DE | 4414478 | * 9/1995 |
| GB | 610896 | * 10/1948 |

* cited by examiner

*Primary Examiner* — Mark Spisich

(74) *Attorney, Agent, or Firm* — Arch & Lake LLP

(57) ABSTRACT

A cleaning device includes a bristle bundle and a handle. The handle has a tubular structure and includes a straight part and a bent part, and the bent part is located at the end of the straight part. The bristle bundle is detachably placed in the tubular structure of the handle, and one end of the bristle bundle extends out of the bent part.

18 Claims, 2 Drawing Sheets

CLEANING DEVICE

CROSS REFERENCE TO RELATED APPLICATIONS

This application claims priority to Chinese Patent Application No. 201810293052.0, filed with the State Intellectual Property Office on Apr. 3, 2018, the entire content of which is incorporated herein by reference for all purposes.

TECHNICAL FIELD

The present disclosure relates to a cleaning device.

BACKGROUND

Various cleaning devices such as toothbrushes, shoe brushes, and the like are used in people's daily life. These cleaning devices have bundles of bristles. A user can place cleaners such as toothpaste, a detergent, and the like on bristles when using the cleaning device.

SUMMARY

The present disclosure provides a cleaning device and a method of manufacturing a cleaning device.

According to one example of the present disclosure, there is provided a cleaning device. The cleaning device may include a bristle bundle and a handle, where the handle has a tubular structure and may include a straight part and a bent part, and the bent part is located at an end of the straight part; and the bristle bundle is detachably placed in the tubular structure of the handle, and one end of the bristle bundle extends out of the bent part.

According to another example of the present disclosure, there is provided a method of manufacturing a cleaning device. The method may include providing a bristle bundle and a handle for the cleaning device; providing a tubular structure for the handle, where the tubular structure may include a straight part and a bent part, and the bent part is located at an end of the straight part; and detachably placing the bristle bundle in the tubular structure of the handle, where one end of the bristle bundle may extend out of the bent part.

It is to be understood that both the foregoing general description and the following detailed description are exemplary and explanatory only and are not restrictive of the present disclosure.

BRIEF DESCRIPTION OF THE DRAWINGS

The accompanying drawings herein, which are incorporated in and constitute a part of the specification, illustrate examples consistent with the present disclosure, and serve to explain the principles of the present disclosure together with the specification.

DETAILED DESCRIPTION

Reference will now be made in detail to examples, examples of which are illustrated in the accompanying drawings. The following description refers to the accompanying drawings in which the same numbers in different drawings represent the same or similar elements unless otherwise represented. The implementations set forth in the following description of examples do not represent all implementations consistent with the present disclosure. Instead, they are merely examples of apparatuses and methods consistent with aspects related to the present disclosure.

The terminology used in the present disclosure is for the purpose of describing a particular example only, and is not intended to be limiting of the present disclosure. The singular forms such as "a", 'said", and "the" used in the present disclosure and the appended claims are also intended to include multiple, unless the context clearly indicates otherwise. It is also to be understood that the term "and/or" as used herein refers to any or all possible combinations that include one or more associated listed items.

It is to be understood that although different information may be described using the terms such as first, second, third, etc. in the present disclosure, and such information should not be limited to these terms. These terms are used only to distinguish the same type of information from each other. For example, the first information may also be referred to as the second information without departing from the scope of the present disclosure, and similarly, the second information may also be referred to as the first information. Depending on the context, the word "if" as used herein may be interpreted as "when" or "as" or "determining in response to."

Figure 1:
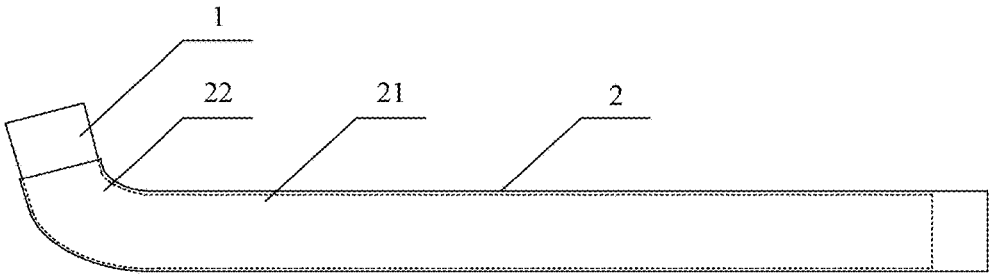
FIG. 1 is a schematic diagram illustrating a structure of a cleaning device according to an example.

The examples of the present disclosure provide a cleaning device which may be a toothbrush and may also be a brush for brushing. Each of all these cleaning devices may include bristles. After the user uses the cleaning device for a long time, especially when the user applies relatively large force on it, it is quite easy for the bristles to incline, which causes a relatively poor cleaning effect of the cleaning device. In order to solve this problem, a cleaning device is provided in this example. As shown in FIG. 1, the cleaning device comprises a bristle bundle 1 and a handle 2. The handle 2 has a tubular structure and comprises a straight part 21 and a bent part 22. The bent part 22 is located at an end of the straight part 21. The bristle bundle 1 is detachably placed in the tubular structure of the handle 2. One end of the bristle bundle 1 extends out of a tube orifice of the bent part 22.

The cleaning device belongs to the technical field of cleaning and may be any product with bristles such as a toothbrush, a shoe brush and so on. In order to explain conveniently, the toothbrush is taken as an example in this example, other situations are similar to the case in this example, and the details are not described herein.

During the implementation, the handle 2 is held by the user. The handle is of a hollow tubular structure in shape and comprises the straight part 21 and the bent part 22. The straight part 21 and the bent part 22 may be integrally formed. The bent part 22 is located at the end of the straight part 21. The central angle of the bent part 22 is a predetermined value and its size is determined mainly according to specific application of the cleaning device. For example, if the cleaning device is the shoe brush or the like, the central angle of the bent part 22 is approximately 90 degrees; and if the cleaning device is the toothbrush or the like, the central angle of the bent part 22 is about 120 degrees. The bristle bundle 1 is composed of a plurality of bristles, and is detachably placed in the tubular structure of the handle 2. In order to expose the bristle bundle 1 from the handle 2, correspondingly, one end of the bristle bundle 1 extends out of the tube orifice of the bent part 22. As such, the bristle bundle 1 is placed in the handle 2 from a tube orifice of the straight part 21 and extends out from the tube orifice of the bent part 22. Herein, a length of the portion, extending out of the tube orifice of the bent part 22, of the bristle bundle 1 is determined according to user's requirements.

Based on the above structure, if the user finds that bristles are inclined in the bristle bundle 1 extending out of the tube orifice of the bent part 22 when using the cleaning device, firstly, the user may cut off the portion, extending out of the tube orifice of the bent part 22, of the bristle bundle 1 with scissors and then pushes the bristle bundle 1 from the tube orifice of the straight part 21 out, so that one end of the bristle bundle 1 extends out of the tube orifice of the bent part 22. As such, when the user uses the cleaning device every time, the bristle bundle 1 extending out of the tube orifice of the bent part 22 is in a good condition. Thus, the cleaning effect of the cleaning device may be improved.

In addition, after the user uses the cleaning device for a long time, the length of the bristle bundle 1 of the cleaning device is shortened. Then, in order to facilitate pushing of one end of the bristle bundle 1 to the tube orifice of the bent part 22, the user can use an external tool, such as a tool with the diameter being smaller than the inner diameter of the handle 2, which pushes the bristle bundle 1 out from the tube orifice of the straight part 21 to move toward the bent part 22, and thus the bristle bundle 1 may extend out of the tube orifice of the bent part 22 and have the proper length all the time.

Figure 2:
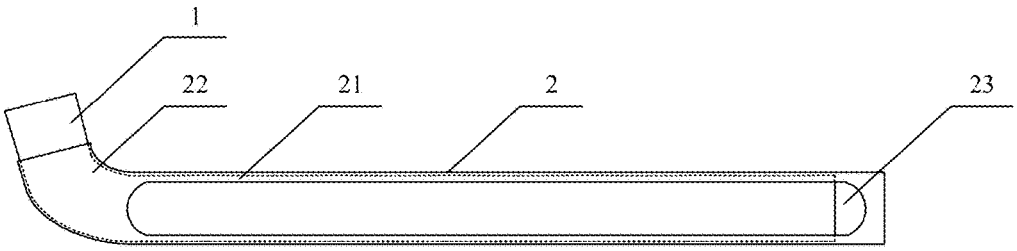
FIG. 2 is a schematic diagram illustrating a structure of a cleaning device according to an example.

In some examples, in order to enable the user to still push the bristle bundle 1 out to move toward the bent part 22 without the external tool, a corresponding structure may be that: as shown in FIG. 2, a strip-shaped opening 23 is arranged on a tube wall of the straight part 21 of the handle 2 along the length direction of the straight part.

During the implementation, the size of the strip-shaped opening 23 may be a predetermined value. To be specific, the length of the strip-shaped opening 23 along the length direction of the straight part 21 is determined according to the length of the straight part 21. For example, the length of the strip-shaped opening 23 is slightly smaller than the length of the straight part 21. The width of the strip-shaped opening 23 is determined according to the size of fingers of the majority of users for the reason that the strip-shaped opening 23 may allow the user to push the bristle bundle 1 to move in the direction of the bent part 22 with the fingers and thus the width of the strip-shaped opening 23 is determined by the size of fingers of most users. There may be one or two strip-shaped openings 23. In the case of two strip-shaped openings 23, the two strip-shaped openings 23 are oppositely distributed on the tube wall of the straight part 21.

As such, after the above cleaning device is used for a long time and shortened, the user may pass the finger through the strip-shaped opening 23 to push an end, close to the tube orifice of the straight part 21, of the bristle bundle 1, so as to enable the bristle bundle 1 to move towards the bent part 22, without the external tool, thereby facilitating the use of the cleaning device by the user.

Moreover, the above strip-shaped opening 23 further has the effect of preventing the bristle bundle 1 from dropping from the tubular structure of the handle 2. To be specific, when the user uses the cleaning device, in order to prevent the user from applying excessively large force to cause that the bristle bundle 1 slides into the tube orifice of the bent part 22, the finger of the user may pass through the strip-shaped opening 23 to block the end, close to the tube orifice of the straight part 21, of the bristle bundle 1 and thus the end of the bristle bundle 1 may be prevented from entering the bent part 22. Therefore, during the process of using the cleaning device by the user, the end of the bristle bundle 1 extends out of the tube orifice of the bent part 22 all the time, thereby guaranteeing the use of the cleaning device.

Figure 3:
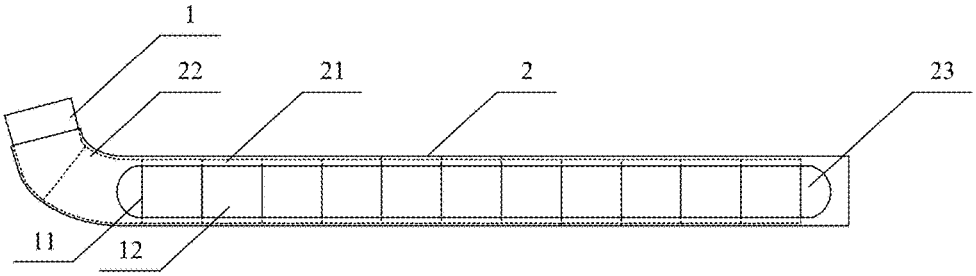
FIG. 3 is a schematic diagram illustrating a structure of a cleaning device according to an example.

In some examples, in order to enable the user to remove the portion, extending out of the tube orifice of the bent part 22, of the bristle bundle 1 conveniently without external scissors, a corresponding structure may be that: as shown in FIG. 3, weak areas 11 are arranged on the bristle bundle 1 at every predetermined length. Bristle sections 12 are formed between adjacent weak areas 11. The diameter of each bristle in the bristle bundle 1 in the weak area 11 is smaller than the diameter of the bristle in a non-weak area.

During the implementation, the whole bundle of bristle bundle 1 is present in sections. That is, the weak areas 11 may be arranged on the bristle bundle 1 at every predetermined lengths. The bristle sections 12 are formed between adjacent weak areas 11. The predetermined length may be determined according to theoretical calculation and a test structure. For example, the predetermined length may be 2 cm. The weak area 11 is an area that is easy to break on the bristle bundle 1. For the bristle bundle 1, the weak area is formed by changing the diameter of the bristle, that is, the diameter of each bristle in the weak area 11 is smaller than the diameter of the bristle in the non-weak area. The bristle sections 12 are formed between adjacent weak areas 11. As such, the whole bristle bundle 1 exists in sections, and the user also uses the cleaning device in sections.

As such, when using the cleaning device, the user may break the used bristle sections 12 in the weak area 11 thereof, and continuously uses the next section of the bristle sections 12. Thus, the user does not need to cut off used bristles with the scissors, and can use the cleaning device normally. It should be noted that when making the bristle bundle 1 extending out of the tube orifice of the bent part 22, the user may make the weak area 11 of the bristle bundle 1 being located in the bent part 22. As such, the situation that the user applies excessively large force to cause the breaking of the bristle sections 12 in the weak area 11 during the use process may be prevented.

In some examples, in order to make the bristle bundle 1 being bundled well, corresponding processing may be that: the periphery of the bristle bundle 1 is covered with an outer thin film. A plurality of holes is arranged in positions, corresponding to the weak areas 11, on the outer thin film.

During the implementation, the outer thin film on the periphery of the bristle bundle 1 may make the bristle bundle 1 being bundled and keep the bristle bundle 1 clean. It is necessary to keep the bristle bundle 1 clean for the reason that due to the existence of the strip-shaped opening 23, the portion, at the strip-shaped opening 23, of the bristle bundle 1 is exposed. Hence, the portion, at the strip-shaped opening 23, of the bristle bundle 1 may be effectively prevented from being exposed by covering the periphery of the bristle bundle 1 with the outer thin film. In addition, the plurality of holes may be arranged in positions, corresponding to the weak areas 11, on the outer thin film, so that the user breaks the used bristle section 12 conveniently at the weak area 11.

Figure 4:
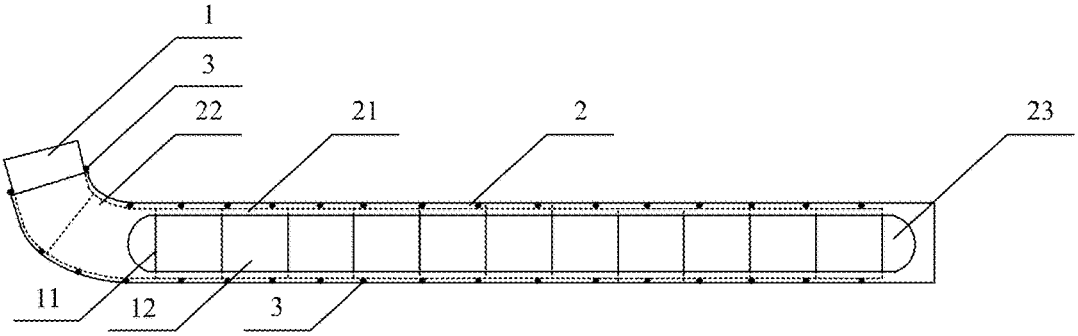
FIG. 4 is a schematic diagram illustrating a structure of a cleaning device according to an example.

In some examples, in order to guarantee that the end of the bristle bundle 1 extends out of the tube orifice of the bent part 22 all the time, a corresponding structure may be that: as shown in FIG. 4, a plurality of spherical limiting protrusions 3 are arranged on an outer wall of the outer thin film. A single row of spherical limiting protrusions 3 may be arranged on the outer thin film of the bristle bundle 1, or as shown in FIG. 4, double rows of spherical limiting protrusions 3 may be arranged on the outer thin film. For example, two rows of spherical limiting protrusions 3 are arranged oppositely. As such, as shown in FIG. 4, the spherical limiting protrusions 3 extending out of the tube orifice of the bent part 22 may be clamped on the tube orifice of the bent part 22, thereby preventing the end of the bristle bundle 1 from sliding into the bent part 22.

Figure 5:
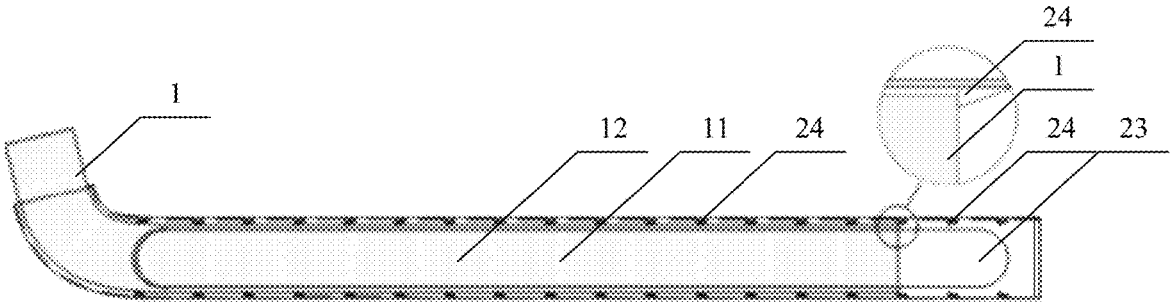
FIG. 5 is a schematic diagram illustrating a structure of a cleaning device according to an example.

In some examples, in order to further guarantee that the end of the bristle bundle 1 extends out of the tube orifice of the bent part 22 all the time, a corresponding structure may be that: as shown in FIG. 5, a plurality of one-way limiting buckles 24 are arranged on an inner wall of the handle 2. The passing direction of the one-way limiting buckles 24 is the direction in which the straight part 21 points to the bent part 22.

During the implementation, the one-way limiting buckles 24 may be arranged on an inner wall of the straight part 21. A single row of one-way limiting buckles 24 may be arranged on one side of the inner wall of the straight part or double rows of one-way limiting buckles 24 may be arranged on the inner wall of the straight part 21. In the case of double rows, two rows of the one-way limiting buckles are distributed on the inner wall of the straight part 21 oppositely. As shown in FIG. 5, a cross-sectional shape of the one-way limiting buckle 24 is a right triangle. One right-angle side of the right triangle is located on the inner wall of the handle 2, and the other right-angle side of the right triangle is close to the tube orifice of the bent part 22 relative to a hypotenuse. As such, the resistance of the bristle bundle 1 as it moves in the direction from the straight part 21 to the bent part 22 is smaller than the resistance when it moves in an opposite direction. In addition, as shown in FIG. 5, the end, close to the tube orifice of the straight part 21, of the bristle bundle 1 is supported on the one-way limiting buckle 24 and thus the one-way limiting buckle 24 may prevent the bristle bundle 1 of the cleaning device from moving in the straight part 21 during a use process, thereby guaranteeing that the end of the bristle bundle 1 extends out of the tube orifice of the bent part 22 all the time.

In addition, when the spherical limiting protrusion 3 and the one-way limiting buckle 24 cooperate with each other for limiting the bristle bundle 1, the spherical limiting protrusion 3 may be clamped on the one-way limiting buckle 24 and thus the bristle bundle 1 may be prevented from moving in the direction from the bent part 22 to the straight part 21, thereby guaranteeing that the end of the bristle bundle 1 extends out of the tube orifice of the bent part 22 all the time. It should be noted that for the case that the spherical limiting protrusion 3 and the one-way limiting buckle 24 cooperate with each other for limiting the bristle bundle 1, the placement of the bristle bundle 1 in the handle 2 is not affected for the reason that the bristle bundle 1 is a soft product and has certain elasticity, and when the bristle bundle 1 is placed from the tube orifice of the straight part 21, the bristle bundle may be placed in the tube of the handle 2 more easily because the bristle bundle 1 is along the passing direction of the one-way limiting buckle 24.

Figure 6:
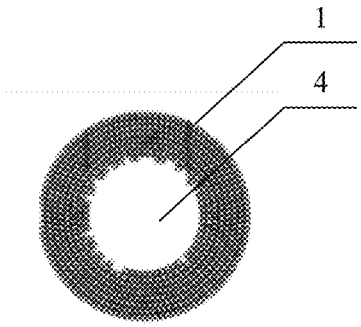
FIG. 6 is a schematic diagram illustrating a structure of a bristle bundle according to an example.
Figure 7:
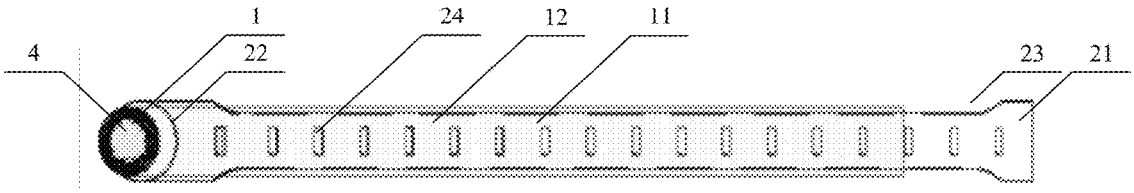
FIG. 7 is a schematic diagram illustrating a structure of a cleaning device according to an example.

In some examples, in order to facilitate the use of the cleaning device by the user, a corresponding structure may be that: as shown in FIG. 6 which is a sectional view of the bristle bundle 1, and FIG. 7, the cleaning device further comprises a gelatinous cleaner 4. The bristle bundle 1 has a hollow tubular structure. An inner thin film perpendicular to the bristle bundle 1 is arranged at a position corresponding to the weak area 11 in the tubular structure of the bristle bundle 1. The gelatinous cleaner 4 is placed in a cavity formed by the inner thin film and the bristle sections 12.

The gelatinous cleaner 4 may be determined according to the practical application of the cleaning device. For example, when the cleaning device is the toothbrush, the gelatinous cleaner is gelatinous toothpaste and when the cleaning device is the shoe brush, the gelatinous cleaner may be gelatinous soap, a gelatinous detergent or the like.

During the implementation, in the process of processing the bristle bundle 1, the bristle bundle 1 may be processed to be of the hollow tubular structure. The inner thin film perpendicular to the bristle bundle 1 is arranged at a position, corresponding to the weak area 11, in the tubular structure of the bristle bundle 1. As such, the cavity is formed by the inner thin film and the inner wall of the bristle section 12. The gelatinous cleaner 4 may be placed in the cavity and thus the bristle bundle 1 and the gelatinous cleaner 4 form a mix of paste and bristles. When the user uses the cleaning device, all that is needed is to strip off the inner thin film covering the gelatinous cleaner 4. In addition, the gelatinous cleaner 4 further has an adhesion effect on the bristle bundle 1. Since the gelatinous cleaner 4 has certain adhesion force, the gelatinous cleaner may adhere the bristles around to one another and prevent the bristles from spreading.

As such, when using the cleaning device, the user strips off the inner thin film on the bristle section 12 extending out of the tube orifice of the bent part 22, and then may use the cleaning device after dipping the mix of the paste and the bristles in water. Further, the cleaning device may be conveniently used by the user. In the case that the cleaning device is the toothbrush, the user may carry it conveniently when going out.

In the examples of the present disclosure, the cleaning device comprises the bristle bundle and the handle. The handle has the tubular structure and comprises the straight part and the bent part, and the bent part is located at the end of the straight part. The bristle bundle is detachably placed in the tubular structure of the handle, and one end of the bristle bundle extends out of the tube orifice of the bent part. If the user finds that the bristles are inclined in the bristle bundle extending out of the tube orifice of the bent part when using the cleaning device, the user can use scissors to cut off the bristle bundle extending out of the tube orifice of the bent part and then push the bristle bundle from the tube orifice of the straight part, so that one end of the bristle bundle extends out of the tube orifice of the bent part. As such, when the user uses the cleaning device every time, the bristle bundle extending out of the tube orifice of the bent part is in the good condition. Thus, the cleaning effect of the cleaning device may be improved.

The present disclosure provides a method of manufacturing a cleaning device. The method may include providing a bristle bundle and a handle for the cleaning device; providing a tubular structure for the handle, where the tubular structure may include a straight part and a bent part, and the bent part is located at an end of the straight part; and detachably placing the bristle bundle in the tubular structure of the handle, where one end of the bristle bundle extends out of the bent part.

The method may also include providing weak areas that are arranged on the bristle bundle at a predetermined length; and forming a bristle section between adjacent weak areas, where the diameter of the weak areas is smaller than the diameter of the bristle section in a non-weak area.

The method may include providing a gelatinous cleaner for the cleaning device, where the gelatinous cleaner is placed in a cavity formed by an inner thin film and the bristle section, where the bristle bundle has a hollow tubular structure, and the inner thin film perpendicular to the bristle bundle is arranged corresponding to the weak areas in the hollow tubular structure of the bristle bundle.

The method may include covering the periphery of the bristle bundle with an outer thin film, wherein a plurality of holes are arranged in positions, corresponding to the weak areas, on the outer thin film.

In the method, a plurality of spherical limiting protrusions may be arranged on an outer wall of the outer thin film.

The method may further include arranging a plurality of one-way limiting buckles on an inner wall of the handle, where a direction to pass the one-way limiting buckles is from the straight part to the bent part.

Other examples of the present disclosure will be apparent to those skilled in the art from consideration of the specification and practice of the present disclosure. This application is intended to cover any variations, uses, or adaptations of the invention following the general principles thereof and including such departures from the present disclosure as come within known or customary practice in the art. It is intended that the specification and examples be considered as exemplary only.

It will be appreciated that the present disclosure is not limited to the exact construction that has been described above and illustrated in the accompanying drawings, and that various modifications and changes can be made without departing from the scope thereof.

What is claimed is:

1. A cleaning device, comprising a bristle bundle and a handle, wherein:

the handle has a tubular structure and comprises a straight part and a bent part, and the bent part is located at an end of the straight part; and the bristle bundle is detachably placed in the tubular structure of the handle, and one end of the bristle bundle extends out of the bent part, wherein weak areas are arranged on the bristle bundle at a predetermined length, a bristle section is formed between adjacent weak areas, and a diameter of the weak areas is smaller than a diameter of the bristle section in a non-weak area, wherein a periphery of the bristle bundle is covered with an outer thin film, wherein a plurality of holes are arranged in positions, corresponding to the weak areas, on the outer thin film, wherein a plurality of spherical limiting protrusions are arranged on an outer wall of the outer thin film.

2. The cleaning device according to claim 1, wherein:

the cleaning device further comprises a gelatinous cleaner; and the gelatinous cleaner is placed in a cavity formed by an inner thin film and the bristle section, wherein the bristle bundle has a hollow tubular structure, and the inner thin film perpendicular to the bristle bundle is arranged corresponding to the weak areas in the hollow tubular structure of the bristle bundle.

3. The cleaning device according to claim 1, wherein a plurality of one-way limiting buckles are arranged on an inner wall of the handle, and a direction to pass the one-way limiting buckles is from the straight part to the bent part.

4. The cleaning device according to claim 3, wherein a cross sectional shape of the one-way limiting buckle is a right triangle, one right-angle side of the right triangle is on an inner wall of the handle, and the other right-angle side of the right triangle is closer to a tube orifice of the bent part than a hypotenuse of the right triangle.

5. The cleaning device according to claim 1, wherein a strip-shaped opening is formed in a tube wall of the straight part at an end thereof opposite the bent part and which enables a force to be applied to an end of the bristle bundle.

6. The cleaning device according to claim 5, wherein a number of the strip-shaped openings exist and the number is 2.

7. A method of manufacturing a cleaning device, comprising:

providing a bristle bundle and a handle for the cleaning device;

providing a tubular structure for the handle, wherein the tubular structure comprises a straight part and a bent part, and the bent part is located at an end of the straight part;

detachably placing the bristle bundle in the tubular structure of the handle, wherein one end of the bristle bundle extends out of the bent part;

providing weak areas that are arranged on the bristle bundle at a predetermined length; and forming a bristle section between adjacent weak areas, wherein a diameter of the weak areas is smaller than a diameter of the bristle section in a non-weak area; and covering a periphery of the bristle bundle with an outer thin film, wherein a plurality of holes are arranged in positions, corresponding to the weak areas, on the outer thin film, wherein a plurality of spherical limiting protrusions are arranged on an outer wall of the outer thin film.

8. The method according to claim 7, further comprising:

providing a gelatinous cleaner for the cleaning device, wherein the gelatinous cleaner is placed in a cavity formed by an inner thin film and the bristle section, wherein the bristle bundle has a hollow tubular structure, and the inner thin film perpendicular to the bristle bundle is arranged corresponding to the weak areas in the hollow tubular structure of the bristle bundle.

9. The method according to claim 7, further comprising:

arranging a plurality of one-way limiting buckles on an inner wall of the handle, wherein a direction to pass the one-way limiting buckles is from the straight part to the bent part.

10. A cleaning device, comprising:

a bristle bundle and a handle, wherein:

the handle has a tubular structure and comprises a straight part and a bent part, and the bent part is located at an end of the straight part; and the bristle bundle is detachably placed in the tubular structure of the handle, and one end of the bristle bundle extends out of the bent part, wherein a strip-shaped opening is formed in a tube wall of the straight part at an end thereof opposite the bent part and which enables a force to be applied to an end of the bristle bundle.

11. The cleaning device according to claim 10, wherein weak areas are arranged on the bristle bundle at a predetermined length, a bristle section is formed between adjacent weak areas, and a diameter of the weak areas is smaller than a diameter of the bristle section in a non-weak area.

12. The cleaning device according to claim 11, wherein:

the cleaning device further comprises a gelatinous cleaner; and the gelatinous cleaner is placed in a cavity formed by an inner thin film and the bristle section, wherein the bristle bundle has a hollow tubular structure, and the inner thin film perpendicular to the bristle bundle is arranged corresponding to the weak areas in the hollow tubular structure of the bristle bundle.

13. The cleaning device according to claim 11, wherein:

a periphery of the bristle bundle is covered with an outer thin film; and a plurality of holes are arranged in positions, corresponding to the weak areas, on the outer thin film.

14. The cleaning device according to claim 13, wherein a plurality of spherical limiting protrusions are arranged on an outer wall of the outer thin film.

15. The cleaning device according to claim 14, wherein a plurality of one-way limiting buckles are arranged on an inner wall of the handle, and a direction to pass the one-way limiting buckles is from the straight part to the bent part.

16. The cleaning device according to claim 15, wherein a cross sectional shape of the one-way limiting buckle is a right triangle, one right-angle side of the right triangle is on an inner wall of the handle, and the other right-angle side of the right triangle is closer to a tube orifice of the bent part than a hypotenuse of the right triangle.

17. The cleaning device according to claim 10, wherein a number of the strip-shaped openings exist and the number is 2.

18. A method of manufacturing a cleaning device as defined in claim 10, comprising:

providing a bristle bundle and a handle for the cleaning device;

providing a tubular structure for the handle, wherein the tubular structure comprises a straight part and a bent part, and the bent part is located at an end of the straight part;

detachably placing the bristle bundle in the tubular structure of the handle, wherein one end of the bristle bundle extends out of the bent part, and forming a strip-shaped opening in a tube wall of the straight part at an end thereof opposite the bent part and which enables a force to be applied to an end of the bristle bundle.

* * * * *